US008302511B1

(12) United States Patent
Adams

(10) Patent No.: US 8,302,511 B1
(45) Date of Patent: Nov. 6, 2012

(54) LEVERAGE TOOL

(76) Inventor: James Adams, Parkton, MD (US)

( * ) Notice: Subject to any disclaimer, the term of this patent is extended or adjusted under 35 U.S.C. 154(b) by 332 days.

(21) Appl. No.: 12/587,804

(22) Filed: Oct. 14, 2009

Related U.S. Application Data

(60) Provisional application No. 61/195,929, filed on Oct. 14, 2008.

(51) Int. Cl.
*B25B 23/16* (2006.01)

(52) U.S. Cl. ..... 81/177.2; 81/177.1

(58) Field of Classification Search ..... 81/177.1, 81/177.2
See application file for complete search history.

(56) References Cited

U.S. PATENT DOCUMENTS

| | | | | |
|---|---|---|---|---|
| 1,396,850 | A * | 11/1921 | Klingbeil | 74/544 |
| 1,511,738 | A | 10/1924 | Lownsberry | |
| 2,725,773 | A | 12/1955 | Anacker | |
| 4,104,935 | A | 8/1978 | Stoops | |
| 5,535,649 | A * | 7/1996 | Waggle, Jr. | 81/177.2 |
| 6,845,692 | B2 | 1/2005 | Cooper | |
| 6,978,703 | B2 * | 12/2005 | Whitehead et al. | 81/176.3 |

* cited by examiner

*Primary Examiner* — Lee D Wilson
*Assistant Examiner* — Shantese McDonald
(74) *Attorney, Agent, or Firm* — Patent & Trademark Services, Inc.; Joseph H. McGlynn

(57) ABSTRACT

A tool for use with other tools to increase their leverage. The tool has a handle with a curved extension connected at an end and the handle has a projection pin. The extension has a slot which receives a projection that can slide along the extent of the slot.

13 Claims, 2 Drawing Sheets

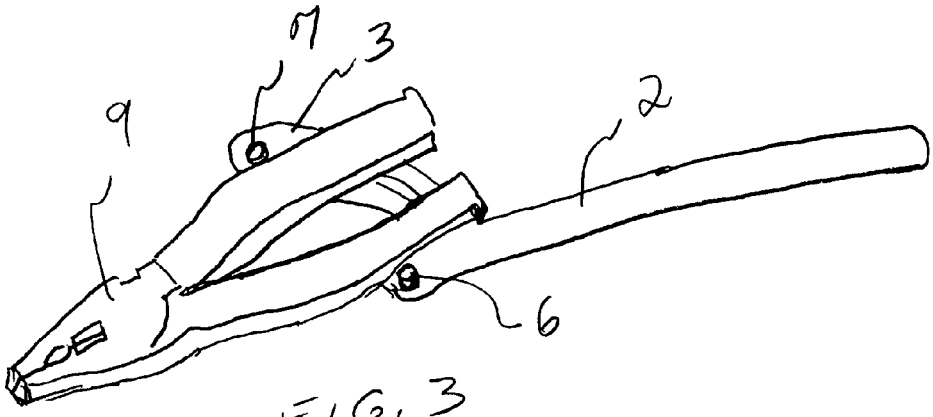
FIG. 3
FIG. 4
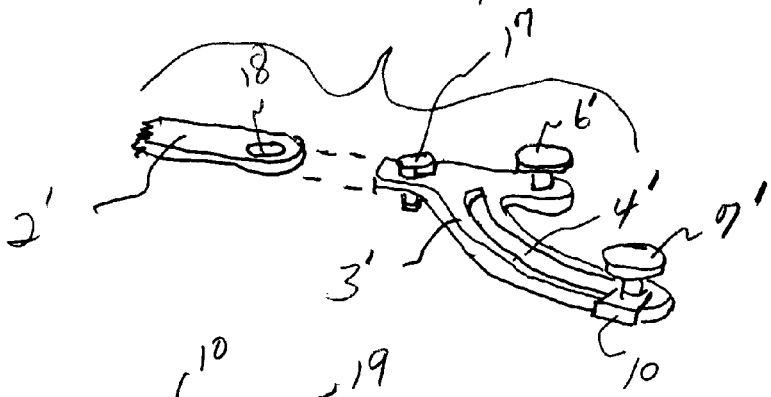
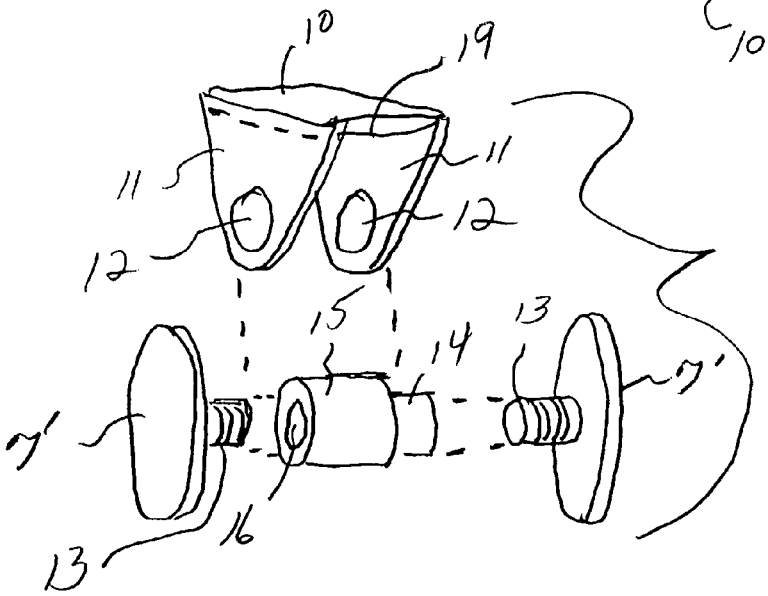
FIG. 5

LEVERAGE TOOL

Applicant claims priority of Provisional application Ser. No. 61/195,929, filed Oct. 14, 2008.

BACKGROUND OF THE INVENTION

This invention relates, in general, to tools, and, in particular, to a tool which can exert additional leverage on other tools.

DESCRIPTION OF THE PRIOR ART

In the prior art various types of devices have been proposed. For example, U.S. Pat. No. 6,848,692 to Cooper discloses a leverage tool that has two fixed pins to apply leverage against a plurality of tools.

U.S. Pat. No. 4,104,935 to Stoops discloses a leverage tool that has a pair of fixed pins, one of which has a socket wrench fitting to apply leverage against a plurality of tools.

U.S. Pat. No. 2,725,773 to Anacker discloses a leverage tool with a plate secured to a handle by a plurality of fixed studs to apply leverage against a plurality of tools.

U.S. Pat. No. 1,511,738 to Lownsberry discloses an extension handle for wrenches having two fixed, opposing clips and a fixed pin.

U.S. Pat. No. 6,978,703 to Whitehead et al discloses a cam gear holding wrench with two arm, one of which is slidable with respect to the other, and the arms have transverse rods projecting therefrom.

SUMMARY OF THE INVENTION

The present invention is directed to a tool for use with other tools to increase their leverage. The tool has a handle with a curved extension connected at one end and the handle has a projection pin. The extension has a slot which receives a projection that can slide along the extent of the slot.

It is an object of the present invention to provide a new and improved tool to be used in combination with a second tool to increase the leverage exerted by the second tool.

It is an object of the present invention to provide a new and improved tool to be used in combination with a second tool which can be used with a variety of second tools.

It is an object of the present invention to provide a new and improved tool to be used in combination with a second tool and the tools can still be used in confined spaces.

It is an object of the present invention to provide a new and improved tool to be used in combination with a second tool in which the tool exerts an automatic tightening pressure on the other tool.

These and other objects and advantages of the present invention will be fully apparent from the following description, when taken in connection with the annexed drawings.

BRIEF DESCRIPTION OF THE DRAWINGS

FIG. 3 is a perspective view of the present invention in use with another tool.

FIG. 4 is a perspective view of the present invention with a detachable handle.

FIG. 5 is a perspective view of the present invention with a clip to hold the movable pin.

DESCRIPTION OF THE PREFERRED EMBODIMENT

The preferred embodiment herein described is not intended to be exhaustive or to limit the invention to the precise form disclosed. It is chosen and described to best explain the invention so that others, skilled in the art to which the invention pertains, might utilize its teachings.

Figure 1:
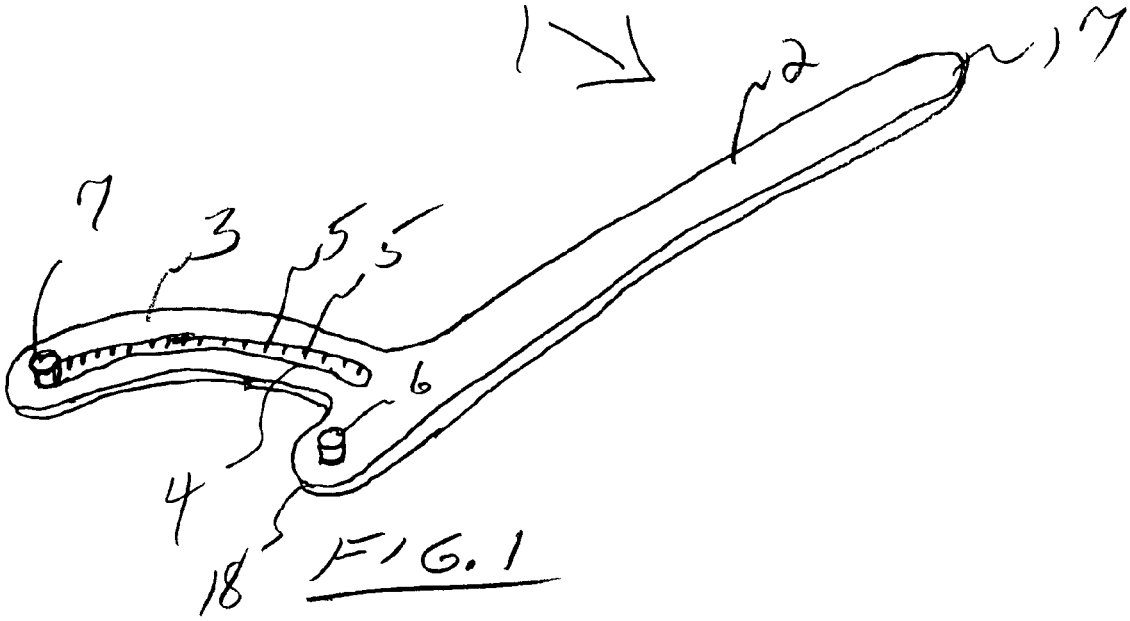
FIG. 1 is a perspective view of the present invention.

Referring now to the drawings in greater detail, FIG. 1 shows a perspective view of the leverage tool 1 of the present invention. The tool has a handle portion 2 with a first end 17 and a curved arm portion 3 connected adjacent a second end 18 of the handle. It is important that the arm 3 be curved as this shape will allow the tool to be inserted into spaces a straight arm would not fit. Also, it allows easier maneuvering of the tool in use. A first pin or anchor 6 is positioned adjacent the second end 18 of the handle. The first pin is fixed with respect to the handle, however, the pin does not have to be permanently fixed. It can be made removable as long as it does not move during operation of the tool.

The curved arm portion 3 has a curved slot 4 that generally follows the curvature of the arm. The slot 4 has a series of teeth 5 or lands and grooves positioned along at least one side of the slot 4. A pin or anchor 7 is positioned in the slot in any conventional manner. The pin 7 is movable in the slot and will engage the teeth 5 when pressure is applied sideways against the pin 7. The engagement between the teeth 5 and the pin 7 will lock the pin in a selected position within the slot 4.

Figure 2:
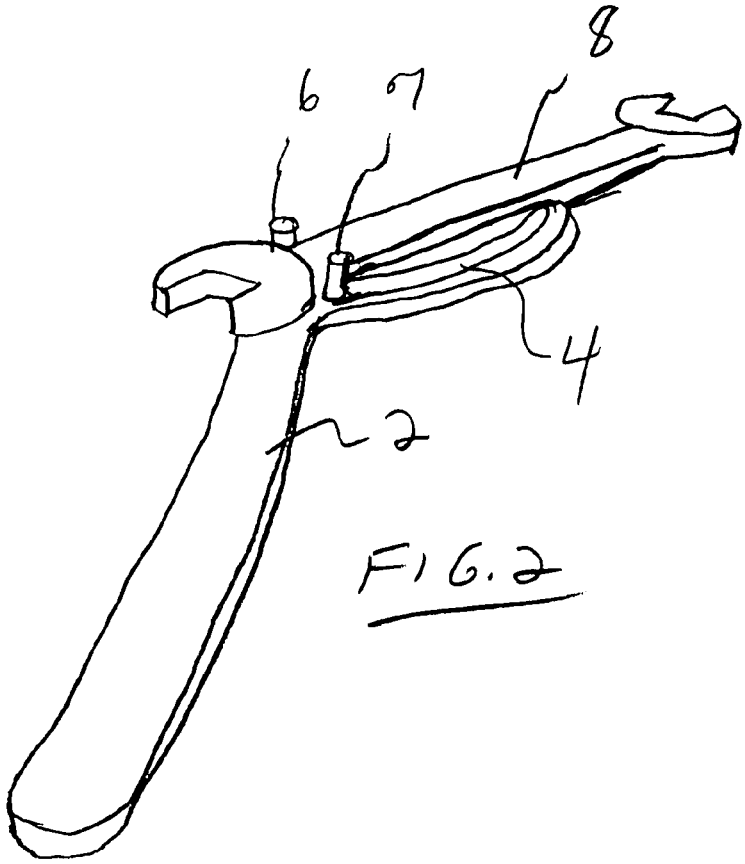
FIG. 2 is a perspective view of the present invention in use with a second tool.

FIG. 2 shows the present invention used with a conventional wrench 8. The wrench is the type with open ended slots at either end, however, the invention is not limited to use with only this type of wrench. The invention can be used with any type of wrench. In order to use the invention, the wrench is positioned on the tool so the end which will not engage a nut or bolt is adjacent the fixed pin 6, The moveable pin 7 is moved along the slot 4 until it engages the wrench 8 on the side opposite the pin 6. Then the opposite end of the wrench can be engaged with a nut or bolt (not shown) and the handle 2 can be rotated. The rotation of the handle will force the pin 7 against the teeth 5 which will lock the pin 7 in position along the slot so it will not slip, and, at the same time lock the wrench between the two pins 6, 7. The length of the handle 2 will be effectively added to the length of the wrench, thereby increasing the amount of leverage the wrench can apply to a nut or bolt.

FIG. 3 shows the present invention being used with a pair of conventional pliers 9. Again, the invention is not limited to use with only this type of pliers. The invention can be used with any type of pliers. The pliers are inserted into the present invention in the same manner that the wrench 8 of FIG. 2 was. It should be noted that the moveable pin 7 is now located at the end of the slot remote from the pin 6. This is due to the shape of the pliers. The handles of the pliers are wider than the handle of the wrench 8, therefore, the pins will have to be placed further apart to receive the handles of the pliers therebetween. Also, as the handle 2 is rotated the pressure of the pins 6, 7 will lock the jaws of the pliers around the object to be turned by the pliers (such as a nut or bolt). Therefore, the user will not have to be concerned with holding the pliers on the object to be turned and rotating the present invention at the same time. All of his efforts can be applied to turning the tool. In all other respects, the invention will operate in the same manner as it does with the wrench 8, FIG. 4 shows the present invention in which the handle 2' is made as a separate piece. An aperture 18 is placed in one end of the handle 2' and can be secured to the rest of the tool by any conventional fastener such as bolt 17. By making the handle as a separate piece different length handles can be supplied for different purposes as a kit. The curved arm 3', the fixed pin 6', the slot 4' and the movable pin 7' all will operate in the same manner as the FIG. 1 device. FIG. 4 also has a clip 10 which will hold the movable pin 7' against the teeth (not shown in FIG. 4) in the slot 4'.

The clip 10 is shown in exploded view in FIG. 5. The clip is essentially U-shaped with two legs 11 extending from the base. Each leg has an aperture 12 extending therethrough. The pin 7' has a head with a threaded stem 13 extending from the head which threads into the body 15. At the opposite end of the body is a projection 14 which is internally threaded. Another pin 7' with another threaded stem 13 is threaded into the projection 14. The clip has a spring 19 positioned adjacent the base in any conventional manner.

The clip is placed onto the curved arm 3' as shown in FIG. 4. The threaded stem 13 is passed through the aperture 12 on one leg 11 and threaded into aperture 16 on the body 15. The projection 14 will align with the aperture 12 in the other leg 11 and the other threaded stem 13 will be threaded into the projection 14 which will hold the clip onto the pin 7' and the spring 19 against the outside of the curved arm 3'. In this manner the spring 19 will always bias the pin against the teeth 5. In order to move the pin 7' a user will have to press the pin against the bias of the spring 19 in order to separate the projection 14 from the teeth. Once the pin in its desired position, the user will release the clip and the spring will force it against the teeth 5 which will hold the pin in the desired position.

Although the Leverage Tool and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A tool for use with other tools to increase their leverage, wherein the tool has a handle, the handle has a first end and a second end, an extension connected adjacent said first end, and said handle has a projection pin adjacent said first end, said extension has a slot extending from said handle, and said slot has a first end and a second end, said slot receives a projection and said projection is movable along the slot, and wherein said slot has means for holding said projection at a selected position along said slot, and wherein means for holding said projection at a selected position along said slot comprises a clip, said clip having a pair of legs extending from a base, and each of said legs has an aperture extending therethrough.

2. A tool for use with other tools to increase their leverage, wherein the tool has a handle, the handle has a first end and a second end, an extension connected adjacent said first end, and said handle has a projection pin adjacent said first end, said extension has a slot extending from said handle, and said slot has a first end and a second end, said slot receives a projection and said projection is movable along the slot, and wherein said projection is comprised of plural parts, one of said parts has a head and a threaded stem, and a body, said body has means for receiving said threaded stem, and a second part which has a head and a threaded stem, and said body has means for receiving said threaded stem on said second part.

3. A tool for use with other tools to increase their leverage, wherein the tool has a handle, the handle has a first end and a second end, an extension connected adjacent said first end, and said handle has a projection pin adjacent said first end, said extension has a slot extending from said handle, and said slot has a first end and a second end, said slot receives a projection and said projection is movable along the slot, and wherein said handle has a longitudinal axis, and wherein said slot has a longitudinal axis, and wherein said longitudinal axis of said slot projects away from said longitudinal axis of said handle.

4. The tool as claimed in claim 3, wherein said extension is curved.

5. The tool as claimed in claim 3, wherein said extension is positioned between said first end and said second end of said handle.

6. The tool as claimed in claim 3, wherein said extension is positioned closer to said first end than to said second end.

7. The tool as claimed in claim 3, wherein said means for holding said projection is a series of lands.

8. The tool as claimed in claim 3, wherein said means for holding said projection is a series of teeth.

9. The tool as claimed in claim 3, wherein handle is comprised of two parts, and one of said two parts contains said extension.

10. The tool as claimed in claim 9, wherein said handle has means for fastening said two parts together.

11. The tool as claimed in claim 1, wherein a spring is affixed to said base.

12. The tool as claimed in claim 1, wherein said projection extends through said aperture in each of said legs.

13. The tool as claimed in claim 1, wherein said pair of legs extend on opposite sides of said extension.

* * * * *